United States Patent [19]

Fantuzzo et al.

[11] 4,372,669

[45] Feb. 8, 1983

[54] ELECTROPHOTOGRAPHIC PRINTING MACHINE

[75] Inventors: Joseph Fantuzzo, Webster; Henry R. Till, Rochester, both of N.Y.

[73] Assignee: Xerox Corporation, Stamford, Conn.

[21] Appl. No.: 278,538

[22] Filed: Jun. 29, 1981

[51] Int. Cl.[3] ..... G03G 15/00

[52] U.S. Cl. ..... 355/3 R; 355/3 CH; 355/14 E; 355/14 CH; 355/15

[58] Field of Search ..... 355/3 R, 3 DD, 3 CH, 355/3 SH, 14 R, 14 E, 14 CH, 15, 3 BE

[56] References Cited

U.S. PATENT DOCUMENTS

| | | | |
|---|---|---|---|
| 4,087,170 | 5/1978 | Sawaoka et al. | 355/3 CH |
| 4,141,648 | 2/1979 | Gaitten et al. | 355/3 CH X |
| 4,265,998 | 5/1981 | Barkley | 355/3 CH X |
| 4,320,958 | 3/1982 | Fantuzzo | 355/3 DD |

*Primary Examiner*—A. C. Prescott

*Attorney, Agent, or Firm*—H. Fleischer; J. E. Beck; R. Zibelli

[57] ABSTRACT

An electrophotographic printing machine in which an original document is reproduced on a copy sheet. The printing machine includes a photoconductive belt arranged to move in a recirculating path. As the photoconductive belt moves through a first cycle, a combined charging-transferring unit charges at least a portion of the photoconductive belt, and a combined exposing-discharging unit focuses a light image of the original document thereon. This records an electrostatic latent image on the photoconductive belt which is developed by a combined developing-cleaning unit. During the second cycle, the charging-transferring unit transfers the toner powder image to the copy sheet, and the combined developing-cleaning unit removes residual particles from the photoconductive belt. After cleaning, the combined exposing-discharging unit illuminates the photoconductive belt to eliminate any charge remaining thereon.

10 Claims, 1 Drawing Figure

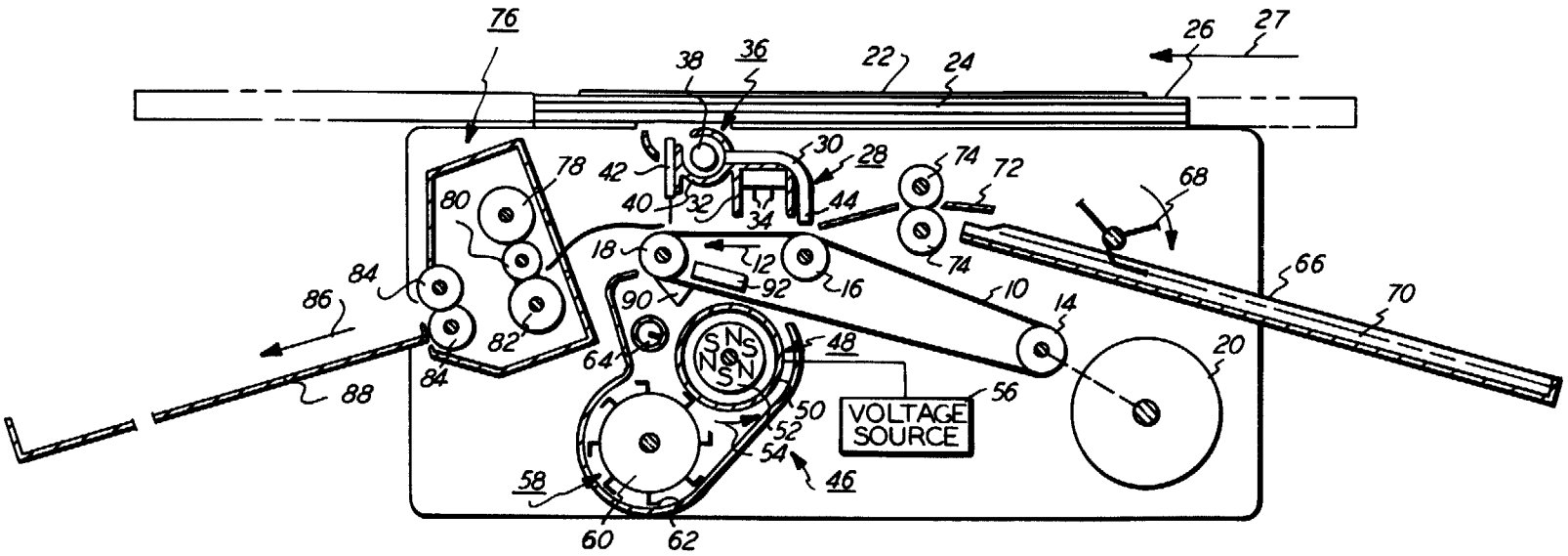
VOLTAGE SOURCE
S N
N S

ELECTROPHOTOGRAPHIC PRINTING MACHINE

This invention relates generally to an electrophotographic printing machine for reproducing an original document on a copy sheet. More particularly, the printing machine of the present invention includes a combined charging-transferring station, a combined exposing-discharging station, and a combined developing-cleaning station.

Generally, in the process of electrophotographic printing, a photoconductive member is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material comprising carrier granules having toner particles adhering triboelectrically thereto into contact therewith. The toner particles are attracted from the carrier granules to the electrostatic latent image to form a toner powder image which is subsequently transferred to a copy sheet. Thereafter, the toner powder image is permanently affixed to the copy sheet in image configuration.

Generally, the various stations for charging, exposing, developing, transferring, cleaning, and discharging are separate units disposed about the photoconductive member. The complexity and associate cost of the printing machine may be significantly reduced if the various separate units are combined to perform dual functions. Hereinbefore, various attempts have been made to achieve the foregoing. In particular, various combination units have been devised for electrophotographic printing machine employing photoconductive drums. However, no such technique has been applied, as of yet, to electrophotographic printing machines employing photoconductive belts. A belt machine may be less complex and produce copies at higher rates than a drum machine. Thus, it is highly desirable to combine various processing units in a photoconductive belt type of printing machine. Various approaches have been devised to combine processing units. The following disclosures appear to be relevant:

- U.S. Pat. No. 3,637,306, patentee: Cooper, issued: Jan. 25, 1972.
- U.S. Pat. No. 3,647,293, patentee: Queener, issued: Mar. 7, 1972.
- U.S. Pat. No. 4,087,170, patentee: Sawaoka et al., issued: May 2, 1978.

The pertinent portions of the foregoing disclosures may be briefly summarized as follows:

Cooper discloses an electrophotographic printing machine employing a combined developing-cleaning unit. The unit is operable to perform either function at the proper time during the copying sequence. This unit is a magnetic brush developer unit that serves both as the developer and cleaner in the system.

Queener also describes a combined developing-cleaning unit. The unit is a magnetic brush developer unit that serves as both a developer and a cleaner in the system. In the developing mode, toner particles are attracted from the carrier granules of the unit to the photoconductive layer. When used in the cleaning mode, the brush rotates and the developer mixture is brushed against the photoconductive layer to scavenge residual toner particles remaining thereon.

Sawaoka et al. discloses an electrostatic copying machine having a rotatable photoconductive drum. The machine includes charge-transfer, exposure-discharge, and develop-clean units. During the first rotation of the drum, charging, exposure and development are affected. In the second rotation, transfer, discharge and cleaning are achieved. The charge-transfer unit performs the functions of charging and transferring with the expose-discharge unit exposing and discharging, and the develop-cleaning unit performing development and cleaning.

In accordance with one aspect of the features of the present invention, there is provided an electrophotographic printing machine for reproducing an original document on a copy sheet. The printing machine includes a photoconductive belt arranged to move in a recirculating path. A combined charging-transferring unit charges at least a portion of the photoconductive belt to a substantially uniform level during movement of the photoconductive belt through a first cycle. The combined exposing-discharging unit focuses the light image of the original document onto the charged portion of the photoconductive belt. This selectively discharges the charged portion of the photoconductive belt recording an electrostatic latent image of the original document thereon. A combined developing-cleaning unit transports developer material comprising carrier granules having toner particles adhering triboelectrically thereto into contact with the electrostatic latent image so that toner particles are attracted thereto to form a toner powder image thereon. Means are provided for positioning the copy sheet adjacent the toner powder image. During the second cycle, the combined charging-transferring unit transfers the toner powder image to the copy sheet. The combined developing-cleaning unit removes the residual toner particles from the photoconductive belt after transfer of the toner powder image to the copy sheet. After removing the residual toner particles from the photoconductive belt, the combined exposing-discharging unit illuminates the photoconductive belt to eliminate the charge thereon.

Other aspects of the present invention will become apparent as the following description proceeds and upon reference to the drawing which depicts a schematic elevational view of an electrophotographic printing machine incorporating the features of the present invention therein.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawing. In the drawing, like reference numerals have been used throughout to designate identical elements. The drawing schematically depicts the various components of an electrophotographic printing machine incorporating the features of the present invention therein. It will become evident from the following discussion that these features are equally well suited for use in a wide variety of electrostatographic printing machines, and are not necessarily limited in their application to the particular embodiment depicted herein.

As shown in the drawing, the electrophotographic printing machine employs a belt 10 having a photoconductive surface deposited on a conductive substrate. Preferably, the photoconductive surface is made from an organic photoconductor with the conductive substrate being made from an aluminum alloy. Belt 10 moves in the direction of arrow 12 to advance success portions of the photoconductive surface through the various processing stations disposed about the path of movement thereof. Rollers 14, 16 and 18 maintain belt 10 under suitable tension. Roller 14 is coupled to drive motor 20. Rollers 16 and 18 are mounted in suitable bearings to rotate freely and act as idler rollers. Motor 20 drives roller 14 to advance belt 10 in the direction of arrow 12.

An original document 22 is disposed facedown upon a transparent platen 24. Platen 24 is mounted in a frame 26 which is capable of reciprocating motion in a horizontal direction, as indicated by arrow 27. Belt 10 is driven at a linear velocity substantially equal to the linear velocity of platen 24. Belt 10 moves in a recirculating path. In order to reproduce a copy of an original document, belt 10 performs two complete cycles of movement through the recirculating path.

During the first cycle, belt 10 advances a portion of the photoconductive surface initially beneath a charging-transferring unit, indicated generally by the reference numeral 28. Charging-transferring unit 28 includes a corona generating device 30 which charges the photoconductive surface of belt 10 to a relatively high substantially uniform potential. Corona generating device 30 includes a U-shaped shield 32 having an open end opposed from the photoconductive surface of belt 10. Two rows of substantially equally spaced pins 34 extend outwardly from shield 32 toward the open end thereof opposed from the photoconductive surface of belt 10.

Next, belt 10 advances the charged portion of photoconductive surface 12 beneath a combined exposing-discharging unit, indicated generally by the reference numeral 36. Combined exposing-discharging unit 36 includes a light source 38, preferably an elongated tungsten lamp. Light source 38 is disposed stationarily beneath platen 24. An opaque shield 40 surrounds light source 38. Shield 40 has a slit therein so that the light rays from light source 38 are projected onto original document 22 disposed facedown on transparent platen 24. As platen 24 moves in the direction of arrow 27, successive incremental portions of original document 22 are illuminated. Light rays reflected from original document 22 are transmitted through a bundle of image transmitting fibers, indicated generally by the reference numeral 42. Image transmitting fibers 42 are bundled gradient index optical fibers. U.S. Pat. No. 3,658,407 issued to Kitano et al. in 1972 describes a light conducting fiber made of glass or synthetic resin which has a refractive index distribution in cross section thereof that varies consecutively and parabolically outwardly from a center portion thereof. Each fiber acts as a focusing lens to transmit part of an image placed at, or near, one end thereof. An assembly of fibers, in a staggered two-row array, transmits and focuses a complete image of the object. The fiber lenses are produced under the tradename "SELFOC"; the mark is registered in Japan and owned by Nippon Sheet Glass Company, Limited. These gradient index lens arrays are used as a replacement for conventional optical systems in electrophotographic printing machines, such use being disclosed in U.S. Pat. No. 3,947,106 issued to Hamaguchi et al., in 1976 and U.S. Pat. No. 3,977,777, issued to Tanaka et al. in 1976. The relevant portions of the foregoing patents are hereby incorporated into the present disclosure. The light rays reflected from the original document are transmitted through the image transmitting fibers onto the charged portions of the photoconductive surface of belt 10 to selectively dissipate the charge thereon. This records an electrostatic latent image on the photoconductive surface of belt 10 which corresponds to the informational areas contained within original document 22. Combined exposing-discharging unit 36 also includes a light transmitting glass fiber optical tube 44. One end of optical tube 44 is disposed closely adjacent to light source 38. The other end of optical tube 44 is positioned closely adjacent to the photoconductive surface of belt 10 prior to combined charging-transferring unit 28 in the direction of movement of belt 10, as indicated by arrow 12.

Thereafter, belt 10 advances the electrostatic latent image recorded on the photoconductive surface to a combined developing-cleaning unit, indicated generally by the reference numeral 46. Combined developing-cleaning unit 46 includes a developer roller, indicated generally by the reference numeral 48. Developer roller 48 comprises an elongated cylindrical magent 52 mounted interiorally of tubular member 50. Tubular member 50 rotates in the direction of arrow 54. Voltage source 56 is electrically connected to tubular member 50 so as to electrically bias tubular member 50 to a potential ranging from about 50 volts to about 500 volts. A specific selected voltage level depends upon the potential level of the latent image and that of the background areas. During development, the biasing voltage is intermediate that of the background and latent image. Conveyor 58 which comprises a cylindrical member 60 having a plurality of buckets 62 thereon advances developer material comprising magnetic carrier granules having toner particles adhering triboelectrically thereto upwardly to developer roller 48. Developer roller 48 attracts the developer material thereto. As tubular member 50 rotates in the direction of arrow 54. The developer material is transported into contact with the latent image and toner particles are attracted from the carrier granules thereto. In this way, a toner powder image is formed on the photoconductive surface of belt 10. Auger 64 mixes the toner particles with the carrier granules. Preferably, tubular member 50 is made from a non-magnetic material such as aluminum having the exterior circumferential surface thereof roughened. Magnetic member 52 is made preferably from barrium ferrite having a plurality of magnetic poles impressed thereon. A metering blade, not shown, may be employed to define a gap between tubular member 50 through which the developer material passes. This gap regulates the quantity of developer material being transported into contact with the electrostatic latent image recorded on the photoconductive surface of belt 10.

After the toner powder image is formed on the photoconductive surface of belt 10, belt 10 returns the toner powder image to the combined charging-transferring unit 28 for the start of the second cycle. At this time, a copy sheet 66 is advanced by sheet feeder 68 to combined charging-transferring unit 28. The copy sheet is advanced in a timed sequence so as to be in synchronism with the toner powder image formed on the photoconductive surface of belt 10. In this way, one side of the copy sheet contacts the toner powder image at combined charging-transferring unit 28. Preferably, sheet fender 68 includes a rotatably mounted cylinder having a plurality of spaced, flexible vanes extending outwardly therefrom. The free end of each vane successively engages the uppermost sheet 66 of stack 70. As feeder 68 rotates, sheet 66 moves into chute 72. Registration roller 74 advances sheet 66, in synchronism with the toner powder image on the photoconductive surface of belt 10, to combined charging-transferring unit 28.

Corona generating device 30 of combined charging-transferring unit 28 sprays ions onto the backside of the copy sheet. This attracts the toner powder image from the photoconductive surface of belt 10 to the sheet. After transfer, the sheet continues to move with belt 10 until the beam strength thereof causes it to strip therefrom as belt 10 passes around roller 18. As the sheet separates from belt 10, it advances to a fuser assembly, indicated generally by the reference numeral 76. Preferably, fuser assembly 76 includes rollers 78, 80 and 82. The sheet passes between rollers 80 and 82 which apply pressure thereon to permanently affix the toner powder image to the copy sheet. Thereafter, exiting rollers 84 advance the sheet in the direction of arrow 86 onto catch tray 88 for subsequent removal from the printing machine by the operator.

As belt 10 advances the residual toner particles adhering to the photoconductive surface is combined developing-cleaning unit 46, a toner particle disturber 90 smears the residual particles adhering to the photoconductive surface. This weakens the attractive force between the residual toner particles and the photoconductive surface. Toner particle disturber 90 includes an elastomeric or foam member extending across the width of belt 10. During the first cycle, the elastomeric member is spaced from the photoconductive surface of belt 10. During the second cycle, a motor driven cam moves the elastomeric member into contact with the photoconductive surface so as to smear the residual toner particles prior to the removal thereof from the photoconductive surface. In lieu of a motor driven cam, one skilled in the art will appreciate that a solenoid may be employed to move the elastomeric member of the toner particle disturber 90 into and out of contact with the photoconductive surface of belt 10. After the residual toner particles have been smeared, the photoconductive surface of belt 10 is illuminated by an electroluminescent light strip 92 disposed interiorly of belt 10. Electroluminescent strip 92 is positioned between tubular member 50 and toner particle disturber 90. This further reduces the charge attracting residual toner particles to the photoconductive surface of belt 10. Thereafter, combined developing-cleaning unit 48 removes the residual toner particles from the photoconductive surface of belt 10. During the second cycle, voltage source 56 electrically biases tubular member 50 to a potential greater than that of the latent image. Thus, during cleaning, voltage source 56 electrically biases tubular member 50 to a potential having a magnitude greater than the developing potential of the first cycle. In this way, the toner particles are attracted to the carrier granules adhering to tubular member 50. Thus, the residual toner particles are removed from the photoconductive surface and returned to the combined developing-cleaning unit for subsequent reuse.

After the residual toner particles have been cleaned from the photoconductive surface of belt 10, the residual charge thereon passes beneath combined exposing-discharging unit 36. At the time, a light shutter permits light rays from light source 38 to be transmitted through fiber optic tube 44 onto the photoconductive surface. These light rays illuminate the photoconductive surface to remove any residual electrostatic charge remaining thereon prior to the charging thereof for the next successive cycle. During the first cycle, the shutter prevents light rays from light source 36 from being transmitted through tube 44.

In recapitulation, it is evident that the electrophotographic printing machine of the present invention utilizes a photoconductive belt which passes through two recirculations for each copy being produced. The printing machine employs a combined charging-transferring unit, a combined exposing-discharging unit and a combined developing-cleaning unit. Thus, during the first cycle, these units perform the functions of charging, exposing and developing. While during the second cycle, they perform the functions of transferring, discharging and cleaning, respectively.

It is, therefore, evident that there has been provided in accordance with this invention an electrophotographic printing machine which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An electrophotographic printing machine for reproducing an original document on a copy sheet, including:

a photoconductive belt arranged to move in a recirculating path;

a combined charging-transferring unit arranged to charge at least a portion of said photoconductive belt to a substantially uniform level during movement of said photoconductive belt through a first cycle;

a combined exposing-discharging unit arranged to focus a light image of the original document onto the charged portion of said photoconductive belt to selectively discharge the charged portion of said photoconductive belt recording an electrostatic latent image of the original document thereon during the movement of said photoconductive belt through the first cycle;

a combined developing-cleaning unit arranged to transport developer material comprising carrier granules having toner particles adhering triboelectrically thereto into contact with the electrostatic latent image so that the toner particles are attracted thereto to form a toner powder image thereon during the movement of said photoconductive belt through the first cycle;

means for positioning the copy sheet adjacent the toner powder image, said combined charging-transferring unit being arranged to transfer the toner powder image to the copy sheet during movement of said photoconductive belt through a second cycle, said combined developing-cleaning unit being arranged to remove residual toner particles from said photoconductive belt after transfer of the toner powder image to the copy sheet during movement of said photoconductive belt through the second cycle, and said combined exposing-discharging unit being arranged to illuminate said photoconductive belt to eliminate the charge thereon after removing the residual toner particles therefrom during the movement of said photoconductive belt through the second cycle;

means, disposed interiorly of said photoconductive belt, for illuminating said photoconductive belt during the second cycle, said illuminating means being positioned after said combined charging-transferring unit and before said developing-cleaning unit in the direction of movement of said photoconductive belt; and means for disturbing the residual toner particles adhering to said photoconductive belt during the second cycle, said disturbing means being positioned after said combined charging-transferring unit and before said illuminating means in the direction of movement of said photoconductive belt.

2. A printing machine according to claim 1, wherein said combined charging-transferring unit includes a corona generating device.

3. A printing machine according to claim 2, wherein said corona generating device includes:

a shield having an open end opposed from said photoconductive belt; and a plurality of spaced pins extending outwardly from said shield toward the open end thereof in the direction of said photoconductive belt.

4. A printing machine according to claim 3, wherein said combined developing-cleaning unit includes:

a rotatably mounted tubular member; and a magnetic member mounted stationarily interiorly of and spaced from said tubular member.

5. A printing machine according to claim 4, wherein said combined developing-cleaning unit further includes means for electrically biasing said tubular member to a first magnitude during the first cycle and to a second magnitude during the second cycle with the second magnitude being greater than the first magnitude.

6. A printing machine according to claim 5, wherein said illuminating means includes an electroluminescent strip.

7. A printing machine according to claim 6, wherein said disturbing means includes:

an elastomeric member; and means for moving said elastomeric member from a position remote from said photoconductive belt during the first cycle to a position contacting said photoconductive belt during the second cycle to smear the residual toner particles facilitating cleaning thereof.

8. A printing machine according to claim 7, wherein said combined exposing-discharging unit includes:

a light source;

means for receiving the light rays transmitted from the original document and focusing a light image of the original document onto the charged portion of said photoconductive belt during the first cycle; and means for directing light rays onto said photoconductive belt in a region after said combined developing-cleaning unit and before said combined charging-transferring unit in the direction of movement of said photoconductive belt during the second cycle.

9. A printing machine according to claim 8, wherein said receiving and focusing means includes a plurality of image transmitting fibers grouped together to receive the light rays transmitted from the original document and to focus the light image thereof onto the charged portion of said photoconductive belt.

10. A printing machine according to claim 9, wherein said directing means includes a light transmitting fiber optic tube having one end thereof adjacent said light source and the other end thereof adjacent said photoconductive belt.

* * * * *